United States Patent [19]

Cavaioli et al.

[11] 4,345,608

[45] Aug. 24, 1982

[54] HAIR LIFT COMB

[76] Inventors: Joseph N. Cavaioli; Joseph R. Cavaioli; James N. Cavaioli, all of Superior Comb Co., 301 Sixth St., Leominster, Mass. 01453

[21] Appl. No.: 257,178

[22] Filed: Apr. 24, 1981

[51] Int. Cl.[3] ..... A45D 24/00

[52] U.S. Cl. ..... 132/160; 132/11 R; D28/31

[58] Field of Search ..... 132/11.3, 11 R, 139, 132/160.1, 141, 142, 118, 162, 126, 136, 112; D28/21, 30, 31

[56] References Cited

U.S. PATENT DOCUMENTS

| | | | |
|---|---|---|---|
| D. 199,657 | 11/1964 | Vallis | D. 28/21 |
| D. 258,541 | 3/1981 | Featherstone | D. 28/31 |
| 2,029,792 | 2/1936 | Pluchino | 132/160 |
| 3,604,431 | 9/1971 | Pearson | D. 28/31 |

*Primary Examiner*—G. E. McNeill

*Attorney, Agent, or Firm*—Charles R. Fay

[57] ABSTRACT

A hair lifting comb having teeth with raised portions alternating at the two sides of the comb.

4 Claims, 3 Drawing Figures

HAIR LIFT COMB

BACKGROUND OF THE INVENTION

Many combs have been made for raising or teasing hair. This invention provides a special toothed comb for enhancing these functions by giving the user's hair a rounder and fuller appearance.

SUMMARY OF THE INVENTION

The comb construction of the present invention resides in the provision of raised portions on and along the teeth which channel, separate and lift the hair upon insertion of the comb into the hair. The raised tooth portions are directed alternately to one side and the other of the comb and the raised portions taper to a maximum thickness intermediate the ends of the raised portions, and they also taper from a point somewhat removed from the extreme ends of the teeth, widening slightly as the raised portions approach the back or handle of the comb. Maximum thickness is about one-quarter inch for best results; and the tip or point of each tooth has approximately a one-half inch plain straight portion that provides faster and deeper penetration into the hair.

No one tooth has a raised part on both sides.

PREFERRED EMBODIMENT OF THE INVENTION

Figure 1:
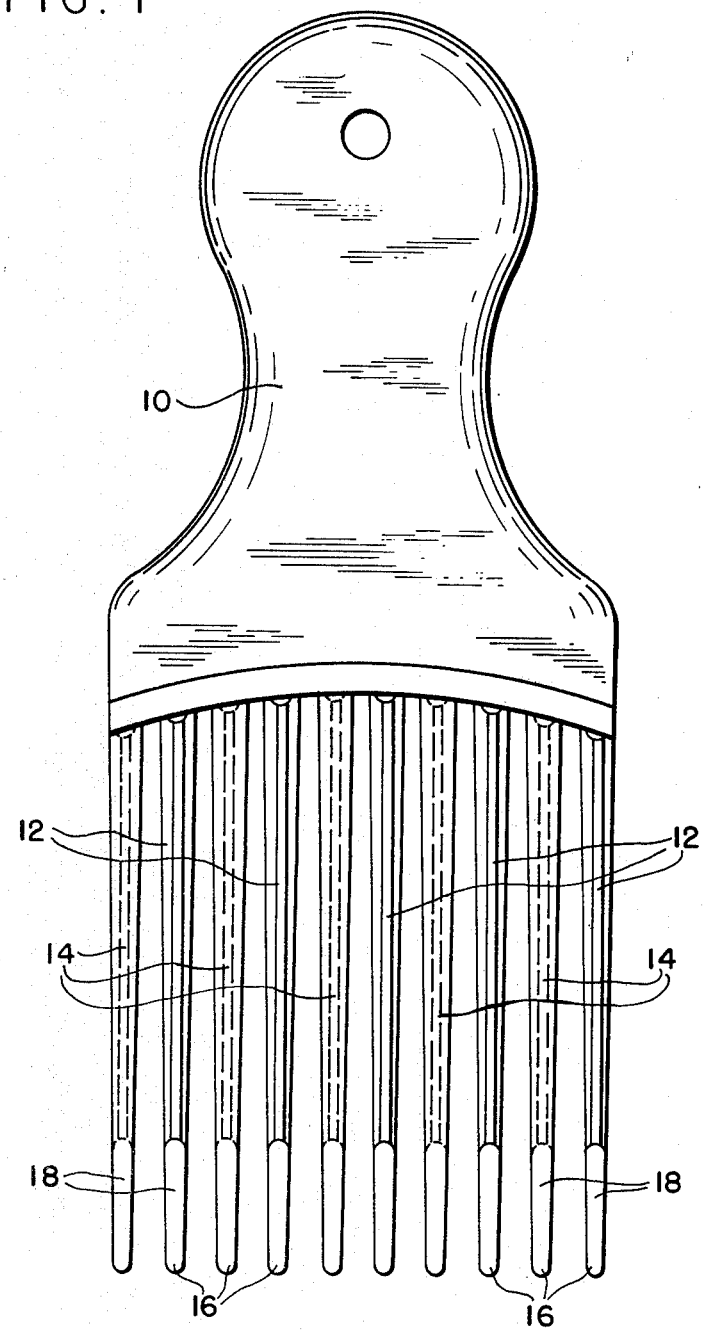
FIG. 1 is a top plan view of the new comb.
Figure 2:
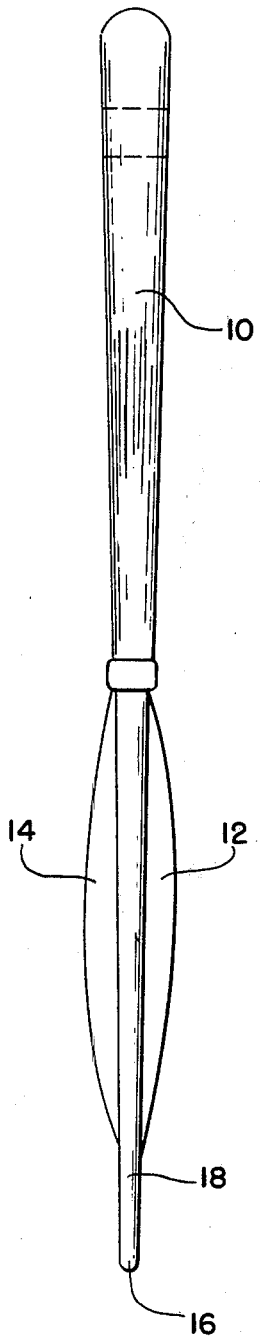
FIG. 2 is a side edge view thereof.
Figure 3:
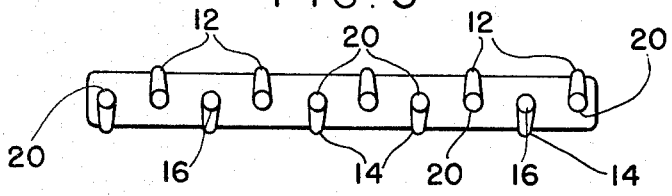
FIG. 3 is a front view.

The teeth of this invention may be formed on a teaser type or ordinary comb back. Starting at the edge of the comb back 10 the teeth are alternately arranged to rise from a center line of the comb, in generally parallel spaced relation, to a maximum as at 12, 14 intermediate the ends of the teeth, and then to descend towards the ends 16. The raised portions leave a conventional tip portion of the tooth 18 for easy insertion into the hair and gradual life of the hair upon thrusting the comb further into the hair.

The teeth are consistently flat on the edges 20 thereof opposite the raised portions, so that the comb is useful at both sides. It is not desired to place the teeth too close together as this would interfere with any easy lifting action in many cases.

The alternate raised tooth portions have a double effect because they lift the hair by pushing it up at one side of the comb and the comb itself is gradually lifted when the raised portions of the teeth at the other side of the comb engage the skull.

We claim:

1. A comb for penetrating and lifting the hair comprising a handle, a series of generally parallel teeth thereon, each tooth including a tapered raised portion thereon along the tooth, said raised portions extending away from the general plane of the several teeth alternately in opposite directions, and each tooth having a plain straight tip at the terminal free end thereof.

2. The comb of claim 1 wherein the raised portions start at the handle, gradually rise and then fall on curves, merging into the straight tips at the ends of the teeth.

3. The comb of claim 1 wherein the raised portions are also tapered at the sides thereof, generally at a right angle to the planes of the raised portions and parallel to the general plane of the comb handle.

4. The comb of claim 1 wherein the teeth are generally straight.

* * * * *